US007478545B1

(12) United States Patent
Gerak et al.

(10) Patent No.: US 7,478,545 B1
(45) **Date of Patent: *Jan. 20, 2009**

(54) SPHERICAL CROCHETED OBJECT

(75) Inventors: Joshua A Gerak, Seattle, WA (US); Gerak Ellen Mary, Seattle, WA (US)

(73) Assignee: Adventure Trading Incorporated, Seattle, WA (US)

( * ) Notice: Subject to any disclaimer, the term of this patent is extended or adjusted under 35 U.S.C. 154(b) by 391 days.

This patent is subject to a terminal disclaimer.

(21) Appl. No.: 11/275,951

(22) Filed: Feb. 6, 2006

Related U.S. Application Data

(63) Continuation of application No. 10/708,150, filed on Feb. 11, 2004, now Pat. No. 6,994,642.

(51) Int. Cl.
*D04B 31/00* (2006.01)
*A63B 45/00* (2006.01)
*A63B 39/06* (2006.01)

(52) U.S. Cl. ..... 66/170; 66/1 R; 473/594; 473/607

(58) Field of Classification Search ..... 66/1 R, 66/169, 170; 112/116, 475.18, 470.35
See application file for complete search history.

(56) References Cited

U.S. PATENT DOCUMENTS

| | | | | |
|---|---|---|---|---|
| 660,787 | A | 10/1900 | Bissell | |
| 1,452,840 | A | 4/1923 | Meyer | |
| 2,399,478 | A | 4/1946 | Ellis | |
| 3,662,878 | A | 5/1972 | Conrad | |
| 4,151,994 | A | 5/1979 | Stalberger, Jr. | |
| D281,521 | S | 11/1985 | Stalberger, Jr. | |
| D287,390 | S | 12/1986 | Charles et al. | |
| 4,943,066 | A | 7/1990 | Lathim et al. | |
| 5,566,953 | A | 10/1996 | Arriola et al. | |
| 5,813,932 | A | 9/1998 | Grafton | |
| 5,893,811 | A | 4/1999 | Stover et al. | |
| 5,915,314 | A | 6/1999 | Moore, III | |
| 6,019,052 | A | 2/2000 | Stucki et al. | |
| 6,067,660 | A | 5/2000 | Contini | |
| 6,394,012 | B1 | 5/2002 | French et al. | |
| 6,994,642 | B2 * | 2/2006 | Gerak et al. | 473/594 |
| 7,225,645 | B1 * | 6/2007 | Henneberg | 66/1 R |

OTHER PUBLICATIONS

"Hoop, Hoop, Hooray!", Stitched Magazine, by Jennifer Lasky, Nov. 1, 2003.

"The Scoop on Hoops", Stitched Magazine, by James A. Lamb, Apr. 12, 2005.

"In the Bag!", Images—The Journal for Textile Screenprinting and Garment Decoration, by Jimmy Lamb, Jan. 1, 2003.

"Embroidery In the Round", Profitable Embroiderer, by Barb Geer, Nov. 1, 2004.

* cited by examiner

*Primary Examiner*—Danny Worrell
(74) *Attorney, Agent, or Firm*—Patents and Licensing LLC; Daniel W. Juffernbruch

(57) ABSTRACT

A spherical crocheted object includes a portion that contains high quality embroidery and is made beginning with a fabric piece called an initial disc. By initially knitting the spherical crocheted object into a flat, round disc of specific and limited dimensions, this initial disc is created for the introduction of an external embroidery process. The crocheted initial disc is tied off to maintain durability during the embroidery step, which is usually performed on specialized embroidery equipment. Thereafter, by vigilantly following specific construction techniques, a ball will be produced that retains its spherical shape resulting in an end product with characteristics similar to that of a spherical crocheted object that does not contain embroidery.

15 Claims, 8 Drawing Sheets

SPHERICAL CROCHETED OBJECT

This application is a continuation of application Ser. No. 10/708,150 filed Feb. 11, 2004, now U.S. Pat. No. 6,994,642.

BACKGROUND OF INVENTION

1. Technical Field

The present invention related to crocheted balls and, more particularly, relates to crocheted balls having an embroidered portion thereof.

2. Related Art

The utilization of spherical crocheted objects for toys, games and recreations have been increasingly popular over the past several years. Initially, crocheted balls were made and sold as toys through many retailers. Now crocheted balls have many additional uses in sports and recreational activities because they are soft, colorful and inexpensive to produce. Crocheted balls and bags have become very popular for use in sports that utilize soft balls including footbag, juggling, toss ball, kick ball, dodge ball and others. Thus, due to their popularity and wide distribution, spherically crocheted objects make an excellent item for advertising and promotional purposes.

One of the more popular utilizations of the spherical crocheted objects is for the game of footbag. An originating patent, U.S. Pat. No. 4,151,994, for the game was issued in May 1979 to Robert J. Stahlberger, Jr. the inventor of the game of footbag (Hacky Sack™). The original ball that was used for this game was a leather paneled style of ball shaped like a baseball. Years later, this original invention was improved upon with the introduction of several newer styles of footbags that touted improved characteristics for the playing of the game. These improved characteristics included a softer style of ball and low bounce characteristics that allowed for greater control and ease of use by the footbag players, who enjoyed the ability to "catch" the ball with the foot and perform a much wider array of athletic footbag tricks. One of the more popular ball types for the game has become the crocheted footbag.

Crochet is a fabric construction that utilizes needlework consisting of the interlocking of looped stitches formed with a single thread and a hooked needle. The popular crocheted ball is a successful implementation of crochet stitching in a round form. Thread types used include cotton, rayon, dacron, polyester or a combination of several thread types. The thread used is of varying degrees of thickness. Depending on the thickness and type of the thread, a crocheted ball will contain larger or smaller stitches which give the ball an appearance of being fuzzier, thicker or rougher. Crocheted balls are made of varying sizes, weights and looseness based on the game played, preference of the participants of the sport, durability and cost. All spherical crocheted objects can be woven by machine or by hand.

Spherical crocheted objects are woven such that rows contain increasing numbers of stitches expanding outward in a spiral form. Thus, the start of a crocheted ball (the "bottom") starts with a single stitch; which is added to in a spiral pattern. This spiral construction soon forms a round disc. The spherical shape forms as the disc construction expands and the stitches are tightened to create a curvature. In the middle of the crocheted ball, the rows contain their maximum number of stitches and determine the diameter of the crocheted ball. For instance, if there are 10 stitches per inch then a ball 8 inches in diameter will contain 80 stitches.

As a crocheted sphere is woven, and after it reaches its maximum diameter, the number of stitches per row is reduced. Thereafter the reduction of each successive row gives the ball its shape and the stitches get tighter and closer together. Before the crocheted sphere weaving is completed, a small hole remains. Before the final closure, the ball is filled with a filling type, which is often plastic resin pellets, bird seed or other types of small or inert filling; then the crocheted object is sealed shut with the final crocheted weave and tied off in a knot. A spherical crocheted object is usually seamless and durable with the final sewing termination.

The filling of a crocheted ball determines its characteristics: slackness, feel and the best utility.

Manufacturers have chosen many different filling types and sizes. Crocheted balls are quite durable, seldom rupture and thus can be used in the most active and aggressive games with little chance of breaking open.

The simplicity and low production cost of the crocheted ball is ideal for many applications in games, sports and toys. Crocheted balls are superior for the purpose of game balls because they are very durable while being malleable and soft at the same time. This offers a longevity not found with paneled balls which tend to break open at the seams. The stresses on the fabrics during the use of crocheted balls are dissipated throughout the stitches of the ball as compared to that of a paneled ball which have limited stitches.

Prior to this invention, spherical crocheted objects have been limited in their ability to purport messages. Previous utilizations were predominantly limited to fabricating crocheted balls with designs built entirely into the crocheted construction. Thus, the primary method has been to directly crochet images into the actual weaving by means of changing the colors of the threads on each individual stitch, usually by hand, to create the necessary contrast to create such images. Although images and logos implemented on existing crocheted balls can be quite complicated and intricate, the fact remains that crocheted balls are limited by the number of stitches per inch inherent in the manufacture of such balls, usually 10 stitches per inch or less, depending on the thickness of the thread used.

Alternative utilizations applied to crocheted balls for the purpose of creating a more useful advertising medium have included other attempts to modify their construction. One known attempt has been the addition of a round panel of fabric sewn into the crocheted ball. This panel, which can be of imitation suede or another durable material, is suitable for screen printing and other suitable advertising purposes; however, there are problems with this incarnation. The basic strength of the ball is dubious due to a fixed fabric seam that is incapable of handling the stresses of hard play, and has been known to come undone. Additionally, the fabric is less flexible than the original crocheted stitches so the ball does not function as well for the preferred active sports that require a softer ball.

Still other manufacturers have attempted variants on crocheted balls to enhance the ability to purport messages or logos. Directly dyeing the crocheted threads is a less successful method of applying words, logos or advertising messages since it is often messy and unprofessional in outcome. Further still, a panel of fabric has been sewn to the exterior of crocheted balls as a means of applying a logo or message. This application is also limited because the size of these fabric pieces must be very small and do not stick well to spherical objects when glued or sewn.

In summary, spherical crocheted objects are inexpensive and mass-produced items used for various sporting, recreational and advertising purposes. To date, the several known attempts to extend the message-carrying functionality of these crocheted objects have had limited success.

SUMMARY OF INVENTION

The invention changes the procedure and method by which a spherical crocheted object is made. The spherical object no longer contains the limits of low quality or low resolution graphics for the purpose of adding an image, a message, logo, words, name or motif. Utilizing our specific production process allows for the inclusion of an embroidery step during the construction of the spherical crocheted object, enhancing the usefulness of products, games and diversions that utilize them.

The embodiment specifies fabrication steps that allow for the addition of an embroidered logo of a limited size. The size restrictions depend upon the size of the final crocheted ball and more specifically, the size of the initial disc of crocheted fabric upon which the embroidery is sewn. This initial disc should not be more than about 30% of the size of the diameter of the spherical crocheted object. Thus, even though crocheted balls are round, our embodiment avoids attempting to crochet on a round object since current technology embroidery equipment does not effectively sew on spherically constructed objects of closed construction, particularly on crocheted or woven balls of loose and fairly thick thread.

In the current embodiment, spherical crocheted objects, such as crocheted balls, are the recipients of the placement of an embroidery message or logo. Crocheted balls are popularly utilized as toys as well as the primary object of several games and sports, such as juggling and Hacky Sack™, also known as the game of footbag, and other games that require a low impact or soft ball that is durable and often malleable.

Prior to our embodiment previous methods of carrying logos or other publicity images on spherical crocheted object were limited, of low quality, too complicated and of a decorative or ornamental nature mainly. The inherent limitations of the medium of construction the loose and thick crocheted stitching meant that inexpensive crocheted balls were less effective tools for promotion by those seeking inexpensive toys or objects for advertising or incentive purposes. Previous attempts at utilizing crocheted balls required that the messages or advertising images be constructed during the initial construction of the spherical crocheted object, on a stitch-by-stitch level, by using different colored threads that were woven to form a crocheted ball. Still other methods have proven less effective on crocheted balls as compared to direct embroidery processes that allow for a much higher quality and higher resolution output.

Of further importance, but no less significant, is the fact that spherical crocheted object can be quite inexpensive to manufacture. This production process has solved the conundrum of utilizing the inexpensive crocheted ball for the purposes of carrying a high quality embroidered figure or message so that the ball may be utilized more effectively in publicizing an embroidered logo, name, motif, image, worded message, monogram, picture or illustration. Thus, the popular inexpensive crocheted ball can now be utilized as a higher quality medium for publicity purposes, advertising tools, corporate premiums, logo messages, or sports tool touting a team logo.

The invention calls for the modification of the fabrication of the crocheted ball so that it is capable to be sewn by high production embroidery machinery. After the embroidery is finished and the ball is completed according to the guidelines contained herein, the crocheted ball retains its round shape, its noteworthy durability and at the same time becomes a more useful advertising and promotion tool.

BRIEF DESCRIPTION OF DRAWINGS

For a fuller understanding of the invention and the process of producing a spherical crocheted object inclusive of embroidery steps, please refer to these drawings in which.

DETAILED DESCRIPTION

Figure 1:
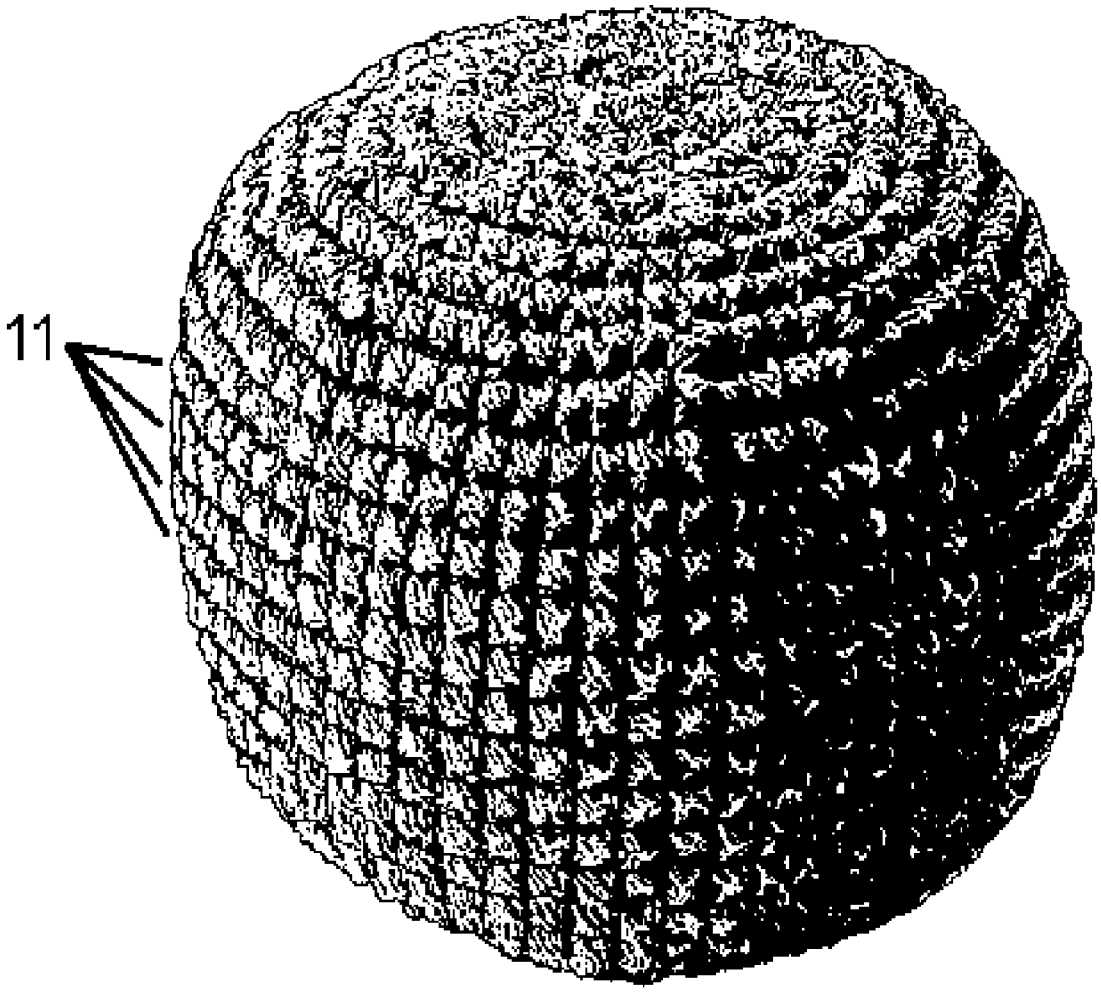
FIG. 1 illustrates a three dimensional view from an elevated and angled aspect of an unadorned ball in a typical size constructed using standard crocheted weaving.

The invention is embodied in the process by which a basic spherical crocheted object, such as a ball, FIG. 1, is fabricated. Additional fabrication steps transform this simply and inexpensively manufactured object, consisting of crocheted rows of thread 11, into a more functional object for displaying a message, logo, words or logo.

Figure 2:
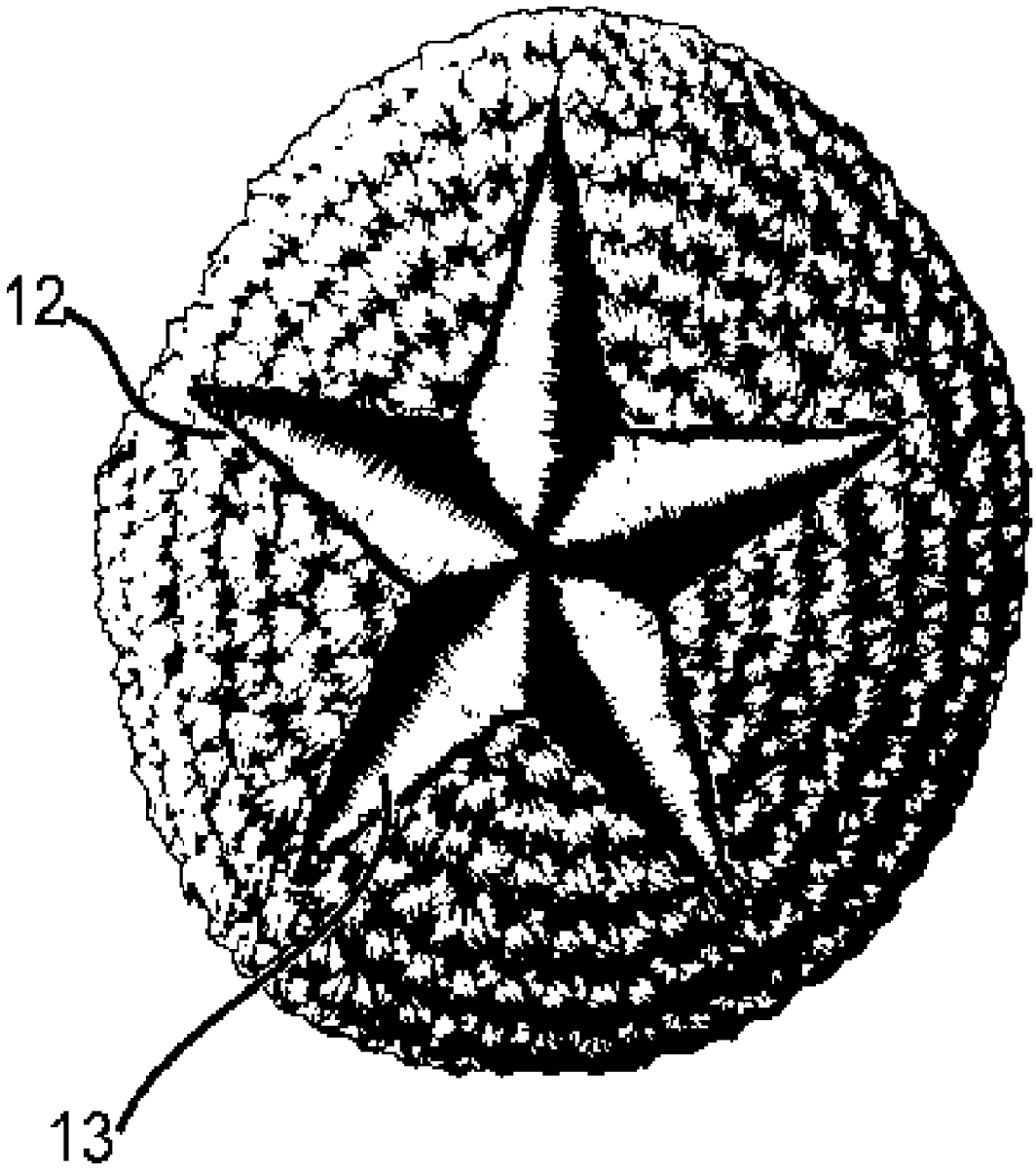
FIG. 2 illustrates a bottom view of a crocheted ball that contains the figure of a star that has been embroidered directly onto the crocheted ball according to the present invention.

FIG. 2 demonstrates the detail when applied to a crocheted ball according to the present invention. A star, 12, is directly embroidered on top of the crocheted ball. Sewing of the embroidery is preferably a step separate and outside of the basic crocheted fabrication. The nature of the embroidery sewing disclosed herein possesses great detail advantages over crocheted objects. Although images, figures and logos fabricated on crocheted objects can be quite complicated and intricate, the fact remains that crocheted objects are restricted in the number of stitches per inch inherent in the manufacture of such objects.

Figure 3:
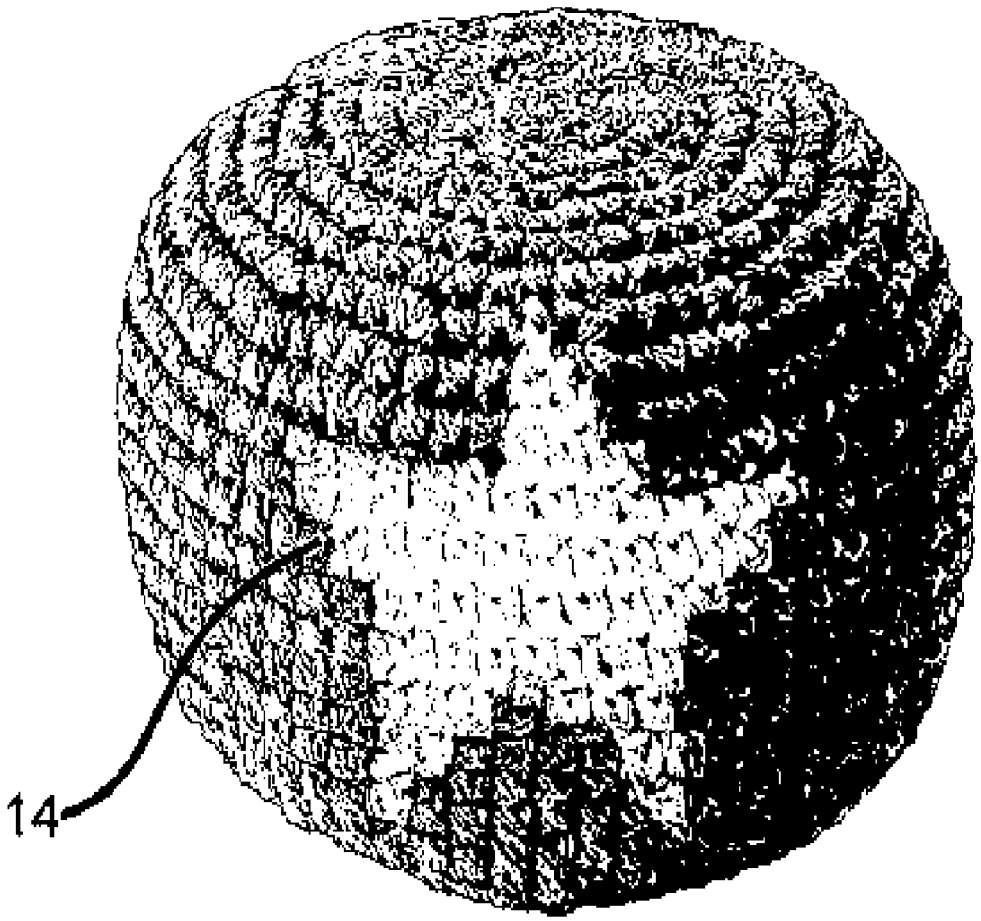
Figure 3 PRIOR ART
FIG. 3 illustrates a three dimensional view from an elevated and angled aspect of a ball containing a star in a contrasting color to that of the base color and that has been crocheted entirely within the ball according to the prior art.

The limitations of the crocheted construction are further evident in FIG. 3 which shows a crocheted star, 14, woven directly into a crocheted ball as is known in the art. This is the most common method of adding artwork or a logo to a crocheted object. It is apparent in FIG. 3 that the star does not elucidate a sharp image. The crocheted star is crude, "blocky," and of minimal detail.

The embroidery sewing of the star 12, in FIG. 2, on the other hand, elucidates a sharp image. One reason for the sharpness of the embroidery sewing is that the stitches in a crocheted object are large as compared to embroidery stitches. Crocheted thread typically contains more plies, or bundles, of heavier weight thread than embroidery thread. Crocheted thread must be thicker and more rigid to be more effectively used with a hooked crochet needle. Crocheting, although appropriate for knitting sweaters and afghans, does not serve well for highly detailed tasks that call for a high amount of detail. On the other hand, embroidery, especially machined embroidery, can utilize many types of thread of a thinner and more supple variety with fewer plies. Embroidering equipment usually uses rayon or polyester thread, which is strong and thin, but can also use thread as fine as silk for highly detailed embroidery stitching.

In FIG. 3 the crocheted stitches contain typically, 10 stitches, or lines, per inch. By contrast, the embroidered stitches 13, in FIG. 3, reveal lines of thread as depicted by the comb teeth-like edge between the black and white arms of the star figure and contain high resolution detail. For every crocheted stitch, there are approximately 8 lines of embroidery. This equates to about 80 lines per inch, or 8 times the number of lines per inch as compared to the crocheted ball examples. Other crocheted objects, when compared to embroidery objects, educe similar quality comparisons.

Figure 4:
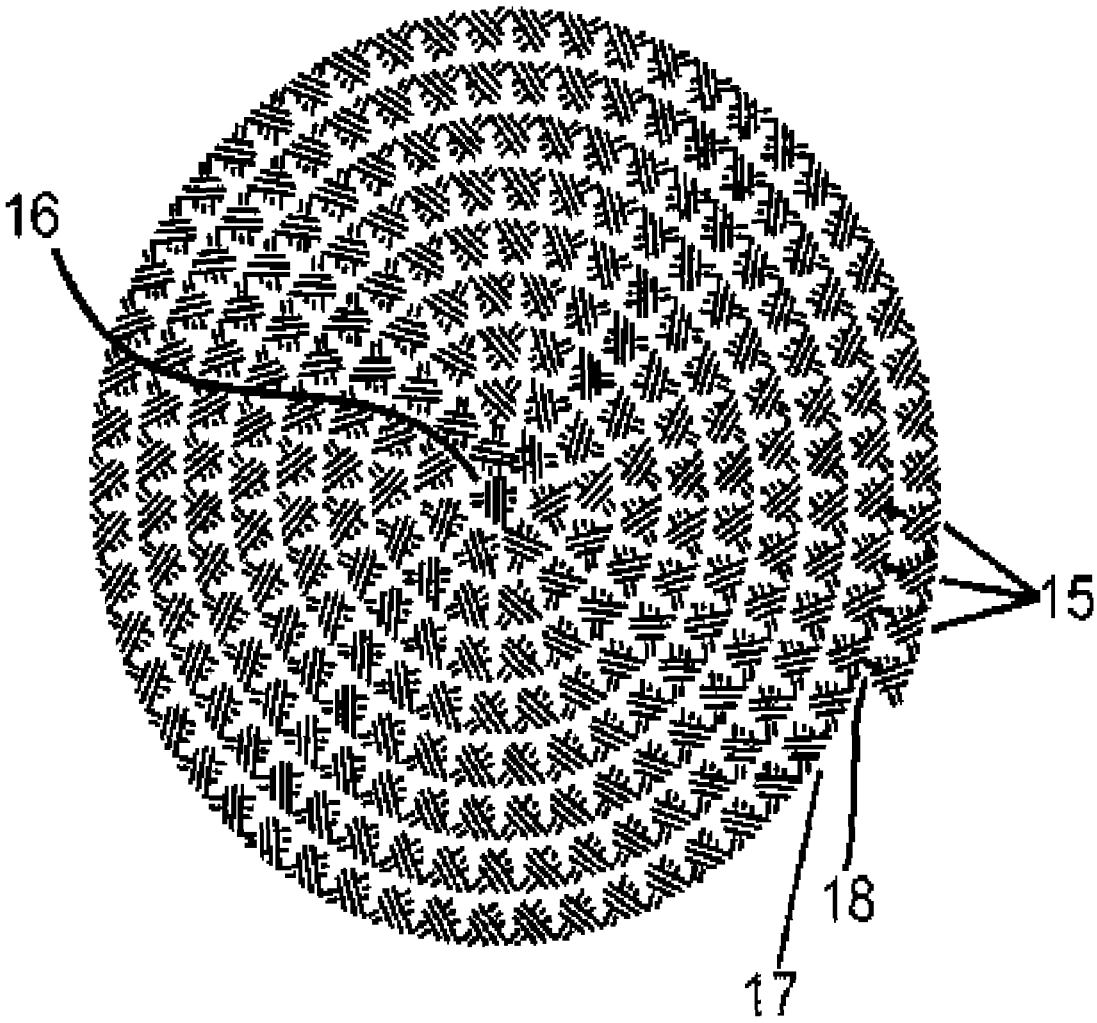
FIG. 4 illustrates a bottom view of a representation of the crocheted initial disc showing individual crocheted stitch detail according to the present invention.

Specific steps contained herein must be followed to permit the addition of the more detailed embroidery process upon spherical crocheted objects. In the drawings, the fabrication of a crocheted ball is being shown. An initial step in creating the ball is to establish a starting point, 16, and crochet in a circular pattern as depicted in FIG. 4. Each individual crocheted stitch is represented by a cross hatched unit because thread used in a crocheted project typically contains multiple plies. In actuality, a crocheted stitch is less clear as the drawing representation in FIG. 4 because crochet thread tends to twist, fray and coalesce, becoming less distinct than the drawing depicts. The first three drawings are better representations of an actual crochet object which shows the thread as thick filaments.

As the crochet stitches are added, they are attached to each proximate stitch as shown in item 15. Likewise, as the stitches are added in a circular motion, they are attached to the proximate row as shown in item 17 using the hooked crocheted sewing technique as depicted in item 18. This technique is the origin for the durability of spherical crocheted objects. In addition, the crocheted object attains the ability to stretch and deform due to a general slackness in this type of multi-plied weaving.

An aspect of producing a spherical crocheted object is the creation of an "initial disc," the product shown in FIG. 4. This initial disc is the base from which the embroidery is fashioned. It is imperative that the last stitch in the construction of the initial disc be tied off so that it does not come unwound. The initial disc must be substantially flat so that it can fit into the commercial embroidery machines for quick and effective stitching. Thus the stitches of the initial disc should not be tightened with each successive woven row. The stitching is created as one would create a flat weaving such as a placemat, coaster or other woven article with the stitches flaring out so that no shape is started. This differs from the current construction of spherical crocheted objects and is one important element of the invention.

The initial disc can be of any crocheted stitch combination upon which embroidery is placed. A solid color is a common choice although crocheted designs can still be used for the initial disc creation. Usually contrasting colors are chosen so the embroidery is visually recognizable and distinct. Any combination of thread colors can be chosen for the embroidery step. Many commercial embroidery machines can be loaded many different color threads so that an entire multi-color design can be done in a few seconds.

It is also important that a diameter of the initial disc is not larger than about 30% of the final circumference of the spherical crocheted object. Thus, for example, in a preferred embodiment, if the spherical crocheted object will have a final circumference of approximately 7.5" inches, the initial disc must be no more than approximately 2.25" inches in diameter when lying flat in order to work best for the embroidery. As the width of the initial disc exceeds 30%, the crocheted object will turn out less spherical, and will look oblong or misshapen. The diameter of the initial disc can be smaller than 30% of the final total circumference; however, a smaller initial disc reduces the area available for the embroidery. It is the upper threshold to which must be observed and adhered in the embodiment. Since the aim is to create an area upon which the higher quality embroidery may be sewn, and a discernible message may be advertised, the goal of maximizing the initial disc size is advised by keeping the diameter of the initial disc about 30% of the final circumference of the spherical crocheted object.

A next step of the invention is to utilize a commercial grade, high quality modern embroidery machine to directly embroider the logo on a substantially flat or the non-curved initial disc. Examples of commercial grade embroidery machines are the Tajima Bridge Type Cylindrical Frame Machine line, the SWF model 1508 multi-head embroidery machine or other equivalent commercial grade machines, either multi-head or single head. Other embroidery machines can be utilized for this step, but for quantity production, the multi-headed machines will function better than the single headed machines. Although machine embroidery is preferred, the embroidery can also be applied by hand. Some embroidery equipment is made for special functions and a wide range of options are available to individuals seeking to create artistically appealing thus effective logos or images.

Figure 5:
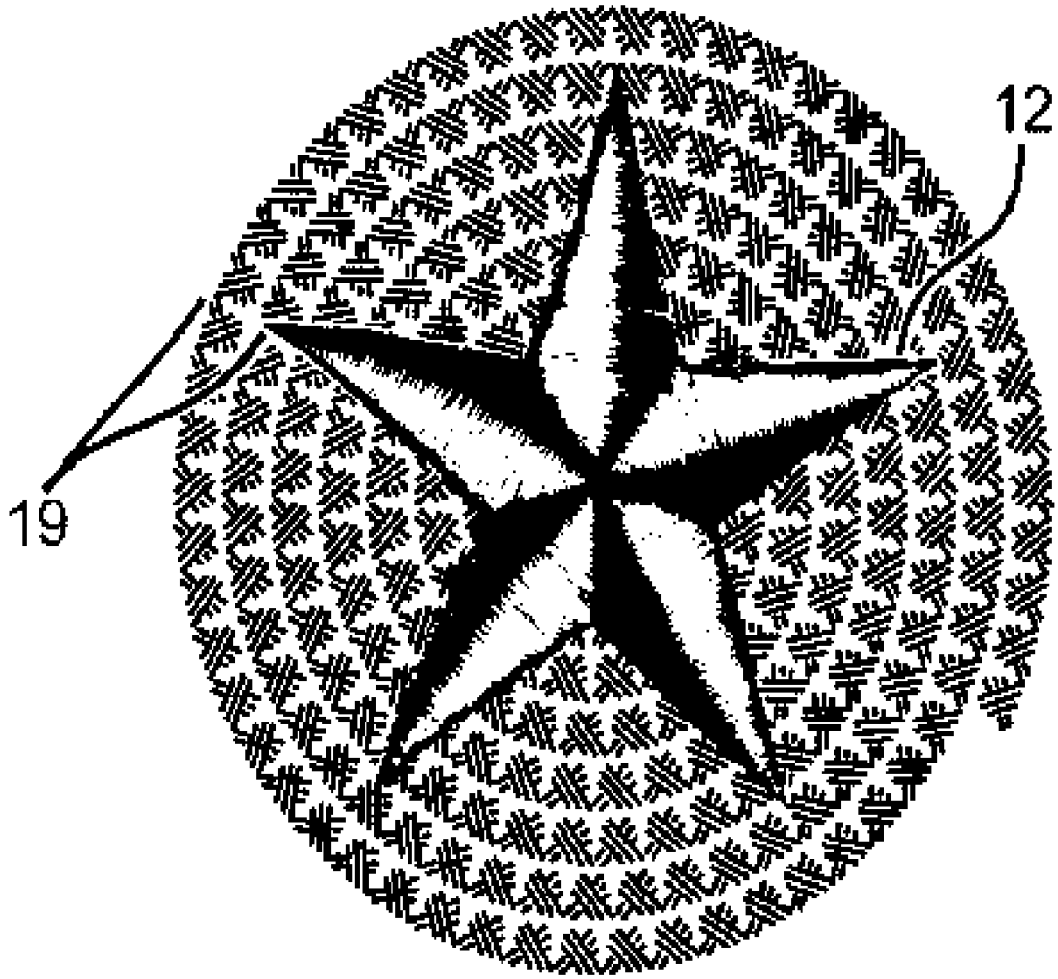
FIG. 5 illustrates a bottom view of a representation of the crocheted initial disc showing individual crocheted stitch detail after the placement of a representative embroidered star figure according to the present invention.

It is, however, important that the embroidery does not exceed the diameter of the initial disc. In FIG. 5, the length of the embroidery is less than 2.25 inches because, in our drawing, this is the diameter of the initial disc. The needle of the embroidery machine should, in fact, remain at least one, preferably two embroidery rows away from the edge of the initial disc as depicted by the separation of the two pointers in item 19. This way a solid and a well defined embroidery logo can be woven firmly onto the initial disc, such as the sample star, 12. It is advised that no paper or fabric backing is used during the embroidery, which is a common step when embroidering with high quality embroidery machines. These backings tend to offer support to the embroidery whereas the article in question for this embroidery is a crocheted disc that needs to remain soft and pliable after the embroidery fabrication step. However, it is up to the manufacturer to determine the final "feel" of the spherical crocheted object. Selecting or not selecting an embroidery backing will affect this result.

The embroidery should then be finished off. Once disconnected from the embroidery machine, all loose threads should be tied off or cut on the front side of the "initial disc." The back side the initial disc may contain loose and unfinished threads. This is acceptable because this portion of the initial disc will be located on the inside of a spherical crocheted object. Although not important to the embodiment, it may be the choice of the manufacturer to trim the extra threads to avoid difficulties in the later fabrication steps, although the economy and complexity of the project may influence this decision. With the completion of the embroidery, the initial disc is ready for the next step of the weaving process.

Figure 6:
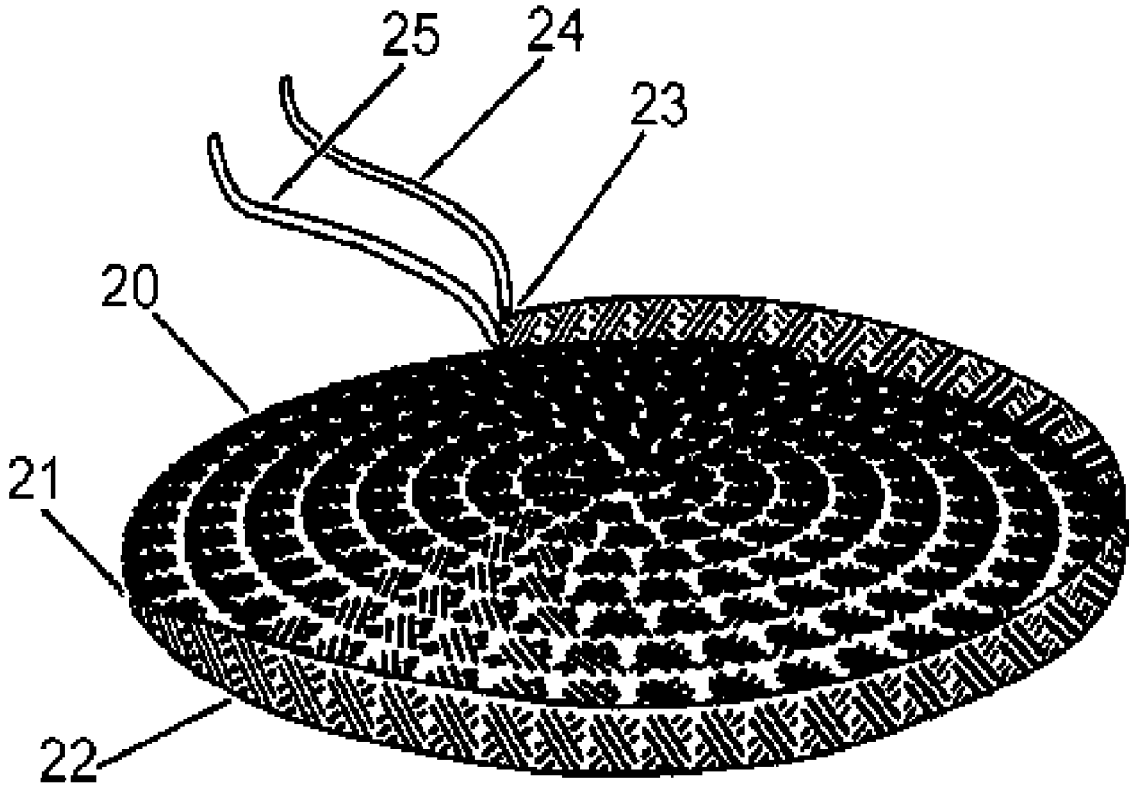
FIG. 6 illustrates a three dimensional view from an elevated and angled aspect of a representation of a crocheted initial disc showing individual crocheted stitch detail after the start of the cylindrical walls according to the present invention.

The next step of the process of an embodiment is illustrated in FIG. 6 and performed on our initial disc. The final stitch that had been tied off is untied and the crochet process continues, only this time the rows are tightened so that the row of stitches bends upward, item 22, starting at point 21. Each successive row of crocheted stitches are woven in a spiral fashion flaring out from the initial disc, 20, and each stitch is hooked into the row beneath it as with the initial disc construction.

This is a crucial point in the fabrication process of the embodiment. Since the initial disc is flat, the ball must be woven so that it forms a spherical object or ball, and to accomplish this, each stitch must be pulled upward as woven at 23, and tightened before they are hooked together. The loose threads, 24 and 25, are crocheted and build upon the rows consecutively. If the color of the crocheted ball is to be solid, then the continuation of the weaving should include the identical color thread; if additional designs are to be included in the final spherical crocheted object, this is a logical point to initiate a thread color change for the creation of a crocheted design on the object.

Figure 7:
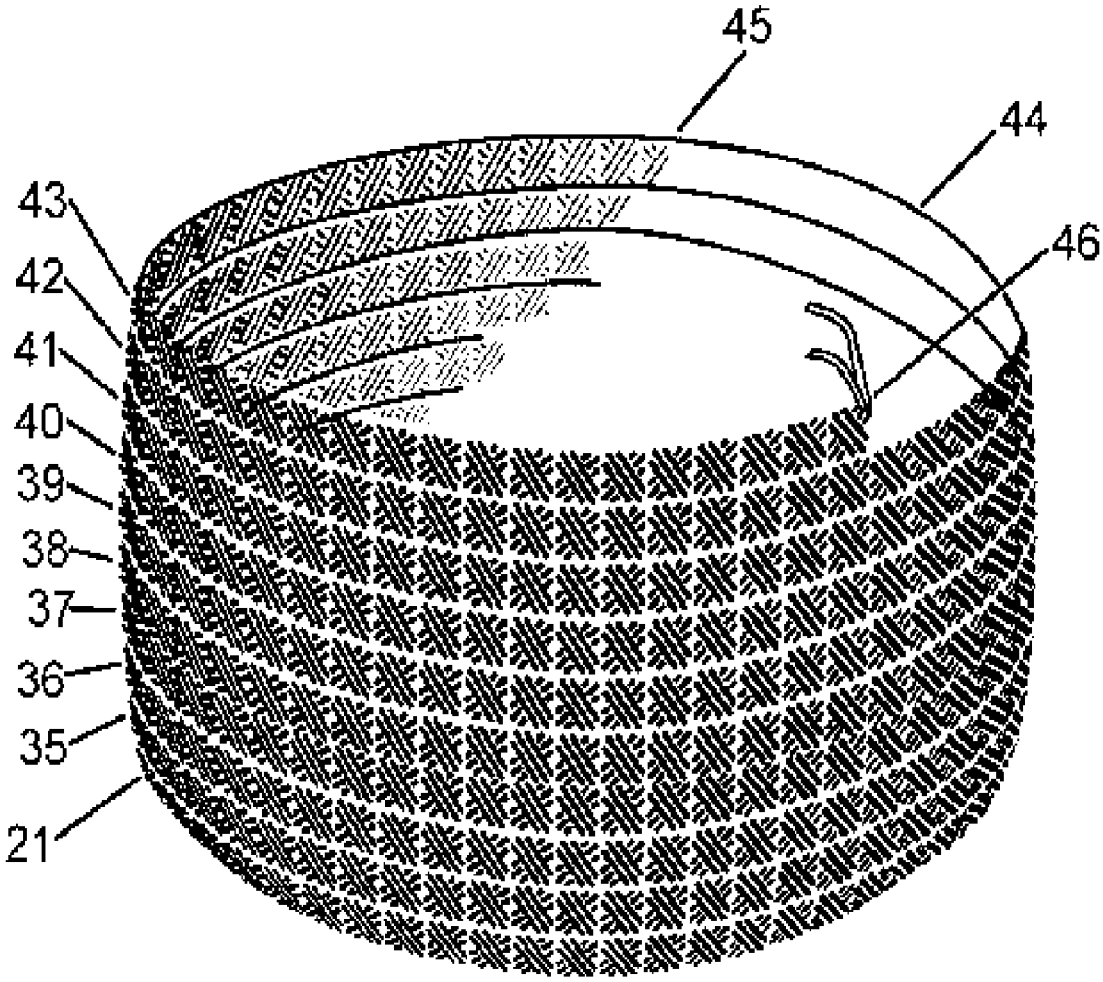
FIG. 7 illustrates a three dimensional view from an elevated and angled aspect of a representation of a crocheted ball construction showing individual crocheted stitch detail inclusive of nearly complete cylindrical walls according to the present invention.

As successive rows are added to the previous row, a cylinder takes shape as shown in the FIG. 7, which looks somewhat like a cylindrical wall with successive and stacked rows of crocheted stitches, 35 through 43. As noted in FIG. 7, the construction of the cylindrical wall is akin to the "side" of the crocheted ball and the bottom, the initial disc, being the initiation point and center that contains the embroidered figure. The top will be the final termination and closure point of the ball. Thus, the ball has a top and bottom for the purposes of our embodiment description and the cylindrical wall will have a center, or point of maximum diameter, which in our drawing lies between rows 38 and 39 because there is an even number of rows. For a construction with an odd number of rows, there would be one row designated as the row of maximum diameter, or center.

A crucial aspect at this important construction stage of an embodiment is in calculating and duplicating the number of stitches per row. The number of stitches per row will vary depending on the size of the initial disc which, as mentioned before, is determined by the desired size of the embroidery logo and the desired size of the crocheted ball. Independent of the ball size, a formula can be utilized for the purposes of the embodiment that will direct the manufacturer to make a crocheted ball that will retain its all important round shape.

In the first row of the crocheted cylindrical wall, it is important to note the number of stitches and abide by some conditions when building upon the cylindrical wall rows. First, the number of stitches should never be reduced when building up the cylindrical walls. The counted stitches may be kept the same or increased slightly to the point that which the maximum diameter of the ball is attained. Reducing the stitches in the successive rows will cause the ball to be misshapen, an undesired result. In FIG. 6, the successive rows contain 60 stitches each. All the rows in the cylindrical walls contain 60 stitches. If rows 35 through 38 contained less stitches than the previous, then the ball may end up misshapen. However, if row 35 contained 61 stitches and row 36 contained 62 stitches, this would be an acceptable iteration for this construction.

The point that which the maximum diameter of the spherical crocheted object is attained is another calculation that is important in the construction in accordance with our embodiment. It has been found that to make a spherical crocheted object like a ball, the cylindrical sides of the ball should have a number of rows that is between around 36% and around 46% of the total number of rows in the construction of the ball. In our drawing, FIG. 5 contains 10 crocheted rows in the cylindrical wall of this crocheted ball which is approximately 38.5% of the total number of rows of this ball construction. In this drawing and in this sample, there are 10 rows on the cylindrical wall. In our drawing it can be determined that the center, or diameter, of the ball is between rows 38 and 39 from the bottom of the cylindrical wall. However, this value can be determined in advance by calculating the midway point in the cylindrical wall using our estimate of acceptable wall size, which can be estimated in advance to be between rows 38 and 39.

Next, once the maximum diameter of the ball is attained, it is acceptable to reduce the number of stitches per row, for rows 39 through 43; or to maintain the same number of stitches in the ball, in order to maintain a round ball. It is not recommended to increase the number of stitches or again a misshapen ball will result. In large scale production, it may be unreasonable to count stitches, so maintaining the same number of stitches for each row in the middle is an acceptable and advisable practice. Once the ball is complete, due to the nature of crocheted stitches, the threads will stretch giving the ball its desired round shape.

It must be noted that the construction of a spherical crocheted object is not a precise science and variations will arise. Variables include the thickness of the thread, size of the stitches and slackness of the stitches. In addition, for the construction of a spherical crocheted object, there is often no definite demarcation as to where the cylindrical wall starts and the bottom construction ends, particularly once the first row in the cylindrical wall is begun and tightened, which tends to warp the entire construction upwards, forcing it into the shape of a ball. Thus, we have supplied relative percentages for the purposes of calculating the proper construction of the embroidered crocheted ball; however, these values are quite close and have been determined over repeated testing and constructions.

Figure 8:
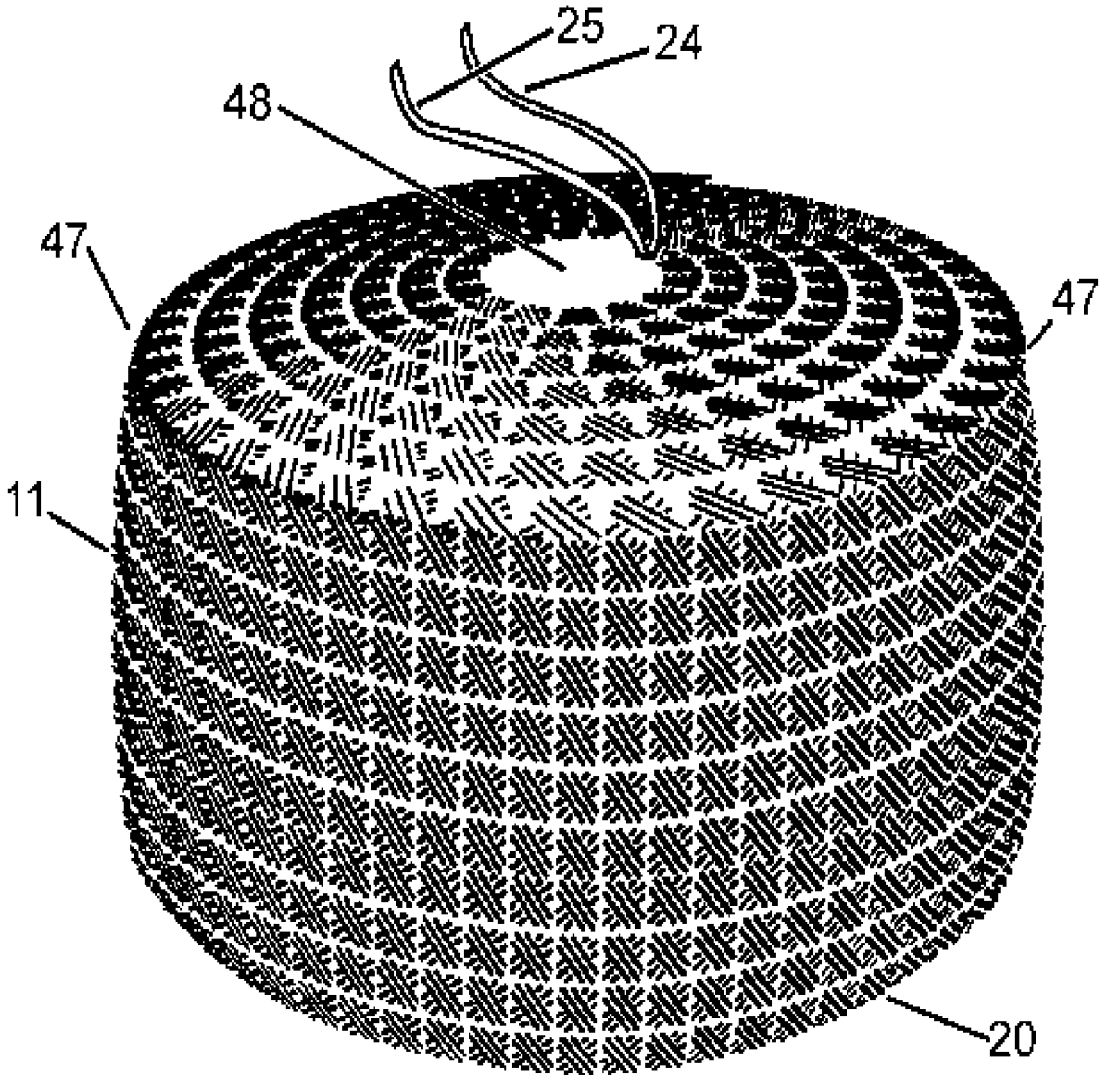
FIG. 8 illustrates a three dimensional view from an elevated and angled aspect of a representation of a crocheted ball construction showing individual crocheted stitch detail inclusive of cylindrical walls and woven top preceding final seamless closure according to the present invention.

In our embodiment, the point at which it can be determined that the cylindrical walls have ended (FIG. 7, item 44 and 45) we complete the top of the embodiment. Taking the remaining loose threads, 46, we start to crochet the top of the ball, bending them as stitches are added as shown in FIG. 8. This crocheting step will generally match the bottom initial disc, 20, of the crocheted ball (in terms of size and number of rows) which contains the embroidered portion of the construction. The embroidery portion can not be viewed in FIG. 8 because it is on the bottom of the ball.

It is important to leave a small hole, 28, in the top of a spherical crocheted object. This hole is where a filling is inserted and a final closure is made. The ball is typically filled with plastic pellets or some other desired filling. The volume percentage of the filling will determine how slack or firm the ball feels. A large number of manufacturers that utilize the crocheted ball for the game of footbag use plastic pellet filling of approximate 2 millimeters diameter in size, of varying shapes, and choose to loosely fill the crocheted ball with from 40 to 75 fill percentage to give the ball the low bounce characteristics desired by many of the players of the game. Manufacturers of crocheted juggling balls tend to fill the crocheted ball with 100 percent fill to give the ball a harder feel and an easier grip which is more suitable for their sport. Many other fill types and combinations exist. In our embodiment, filling and closure are all part of the normal manufacture found in the production of crocheted balls. Note in FIG. 8 that a hole has been left with two loose threads, 24 and 25. Commonly the extra thread is left to perform the final closure after filling.

The final closure is done using the crochet hooked needle and tied off to seal the construction.

Due to the pliant and soft nature of the thread materials such as those used in the fabrication of spherical crocheted objects, once completed, the object will lose the cylindrical shape and transform into the shape of a ball. This transformation can be accentuated by compressing or kneading the ball under pressure which will stretch out the stitches to give the crocheted ball a more round appearance, and will enhance the playability features desired in a ball of this type.

By following the construction process laid forth herein, a spherical crocheted object will have been successfully created that contains an embroidered logo and that can be duplicated on a large scale.

What is claimed is:

1. A crocheted object comprising:

an initial disc comprising successive crochet rows in a spiral with at least one end thread (24, 25) at an outer end of the spiral;

an embroidered portion embroidered on an outer surface of the successive crochet rows of the initial disc; and a further crocheted portion comprising additional crochet rows in a closed shape, an end (46) of the additional crochet rows joined near the at least one end thread (24, 25) at the outer end of the spiral of the initial disc.

2. A crocheted object according to claim 1, wherein the closed shape comprises a substantially spherical shape.

3. A crocheted object according to claim 1, wherein the additional crocheted rows form sides of around 36% to around 46% of a total number of crocheted rows of the spherical crocheted object.

4. A crocheted object according to claim 1, wherein a maximum dimension of the embroidered portion has a diameter no greater than about 30% of a circumference of the crocheted object.

5. A crocheted object according to claim 4, wherein the maximum dimension of the embroidered portion has a diameter of no more than approximately 2.25 inches.

6. A crocheted object according to claim 5, wherein the shape has a circumference of approximately 7.5' inches.

7. A crocheted object according to claim 4, wherein the shape has a circumference of approximately 7.5' inches.

8. A crocheted object according to claim 1, wherein the maximum dimension of the embroidered portion has a diameter of no more than approximately 2.25 inches.

9. A crocheted object according to claim 8, wherein the shape has a circumference of approximately 7.5' inches.

10. A crocheted object according to claim 1, wherein the shape has a circumference of approximately 7.5' inches.

11. A crocheted object according to claim 1, wherein the embroidered portion has characteristics sufficient to promulgate a high resolution message, logo, slogan, or advertisement.

12. A crocheted object according to claim 1, wherein the embroidered portion has characteristics sufficient to promulgate a high resolution image chosen from the group consisting of a message, logo, slogan, and advertisement.

13. A crocheted object according to claim 1, wherein the crocheted object is a ball.

14. A crocheted object according to claim 11, wherein the high resolution message, logo, slogan, or advertisement has a resolution of about 80 lines per inch.

15. A crocheted object according to claim 12, wherein the high resolution image has a resolution of about 80 lines per inch.

* * * * *